US005407155A

United States Patent [19]

Chung

[11] Patent Number: 5,407,155

[45] Date of Patent: Apr. 18, 1995

[54] AUTOMATIC SUPPORT STAND FOR GOLF BAG

[75] Inventor: Chang K. Chung, Seoul, Rep. of Korea

[73] Assignees: Soon Ja Lee; YounJoung Lee, both of Seoul, Rep. of Korea

[21] Appl. No.: 133,570

[22] Filed: Oct. 8, 1993

[30] Foreign Application Priority Data

May 27, 1993 [KR] Rep. of Korea ..... 9157/1993

[51] Int. Cl.[6] ..... A63B 55/00

[52] U.S. Cl. ..... 248/96; 248/168; 206/315.7

[58] Field of Search ..... 248/96, 168, 169; 206/315.7, 315.8; 16/341

[56] References Cited

U.S. PATENT DOCUMENTS

| | | | |
|---|---|---|---|
| Re. 33,203 | 4/1990 | Reimers | 206/315.5 |
| 1,197,298 | 9/1916 | McGregor . | |
| 1,769,011 | 4/1928 | Bickford | 248/96 |
| 2,672,311 | 3/1954 | Schiele | 248/96 |
| 2,695,760 | 11/1954 | Carpenter | 248/96 |
| 2,751,176 | 6/1956 | Mowry | 248/96 |
| 3,195,844 | 7/1965 | Roepke | 248/96 |
| 4,226,389 | 10/1980 | Neth | 248/96 |
| 4,506,854 | 3/1985 | Kim | 248/96 |
| 4,620,682 | 11/1986 | Yim | 248/96 |
| 4,676,464 | 6/1987 | Reimers | 248/96 |
| 4,767,001 | 8/1988 | Kim | 206/315.3 |
| 4,778,136 | 10/1988 | Reimers | 248/96 |
| 4,796,752 | 1/1989 | Reimers | 206/315.3 |
| 4,834,235 | 5/1989 | Solheim et al. | 206/315.7 |
| 4,844,253 | 7/1989 | Reimers | 206/315.6 |
| 4,921,192 | 5/1990 | Jones | 248/96 |
| 4,949,844 | 8/1990 | Yang | 206/315.7 |
| 5,036,974 | 8/1991 | Ross, Jr. | 206/315.7 |
| 5,042,654 | 8/1991 | Jones | 206/315.3 |
| 5,074,577 | 12/1991 | Kim | 280/646 |
| 5,082,218 | 1/1992 | Hoffman | 248/96 |
| 5,096,148 | 3/1992 | Quellais et al. | 248/96 |
| 5,147,089 | 9/1992 | Anderson | 248/96 |
| 5,152,483 | 10/1992 | Maeng | 248/96 |
| 5,154,377 | 10/1992 | Suk | 248/96 |
| 5,156,366 | 10/1992 | Anderson | 248/96 |
| 5,178,273 | 1/1993 | Igarashi | 206/315.7 |
| 5,209,350 | 5/1993 | Maeng | 206/315.7 |
| 5,236,085 | 8/1993 | Quellais | 206/315.7 |
| 5,339,951 | 8/1994 | Chen | 206/315.7 |

FOREIGN PATENT DOCUMENTS

| | | | |
|---|---|---|---|
| 118231 | 2/1932 | Australia | 248/96 |

OTHER PUBLICATIONS

Sun Mountain Sports—Eclipse Information Tag.
Sun Mountain Sports—Product Guide.
Introducing the CSB-46 Tripod Cadabag—Korex Corporation.

*Primary Examiner*—Karen J. Chotkowski
*Assistant Examiner*—Catherine S. Collins
*Attorney, Agent, or Firm*—Lockwood, Alex, Fitzgibbon & Cummings

[57] ABSTRACT

A device is provided for supporting a golf bag having support legs extended and retracted as required. The device has an upper hinge bracket fixed to an upper portion of a golf bag, a lower hinge bracket fixed to a lower portion of the golf bag, a support leg assembly having an upper hinge element, an offset actuating lever pivotally connected to the lower hinge bracket and having a lower hinge element, and an actuating assembly pivotably connected between the upper hinge element and the lower hinge element. The offset actuating lever is pushed upwardly by contact with the ground so that support legs are extended by the upward movement of the actuating lever and the rods when the golf bag is tilted toward the support legs on the ground while the support legs are retracted by its own weight when the golf bag is erected.

28 Claims, 3 Drawing Sheets

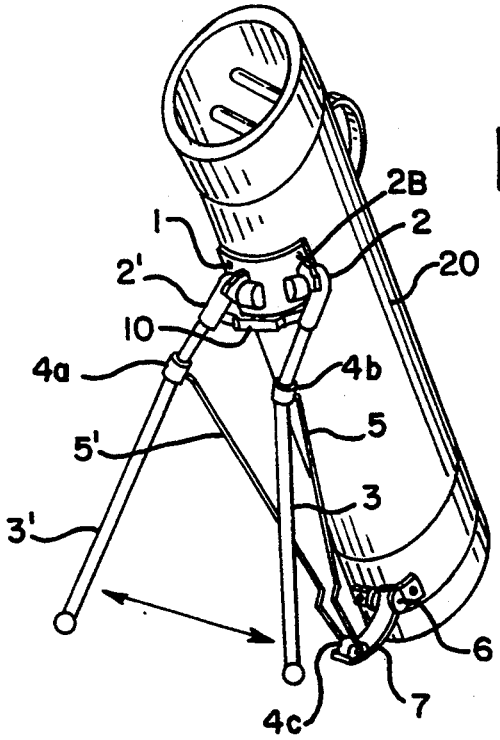
FIG. 4
FIG. 4A
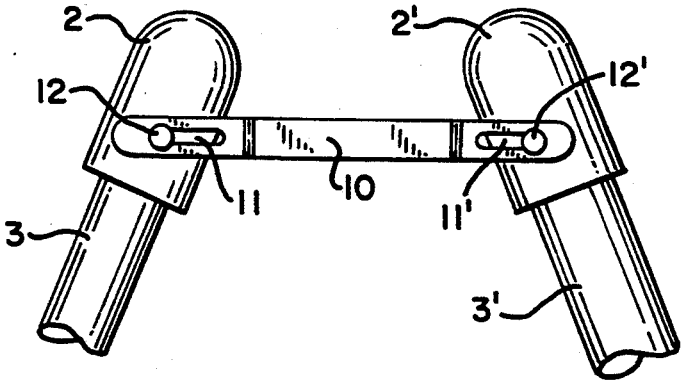
FIG. 5A
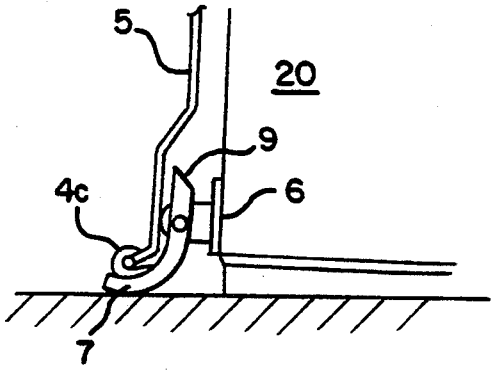
FIG. 5B
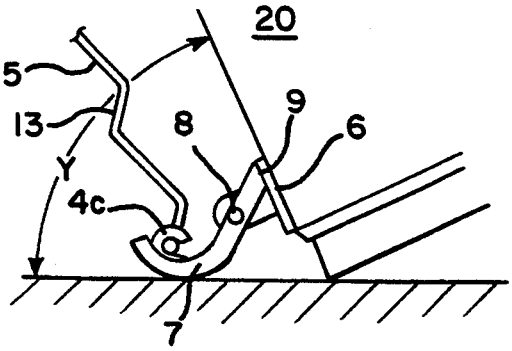

AUTOMATIC SUPPORT STAND FOR GOLF BAG

BACKGROUND OF THE INVENTION

1. Field of the Invention

The present invention relates to a device for supporting a golf bag and a golf bag thus supported. More particularly, the device supports a golf bag at a predetermined extended angle of support legs regardless of unevenness of the ground and the weight of the golf bag having the support device, which features legs adapted to be automatically extended when the bag is moved to its inclined orientation and automatically retracted when stood upright or lifted off of the ground.

2. Description of the Prior Art

Devices for supporting golf bags having legs that automatically extend and retract are generally known. For example, Korean Utility Model Application No. 83-7823 describes a device for supporting a golf bag in which support members are retracted against the resiliency of a resilient actuating rod as the golf bag is erected into an upright position, while the support members are extended by the resiliency of the resilient member as result of a change in location of the resilient member as the golf bag is inclined. This device for supporting a golf bag is designed to be simplified in its design and to be lightened in its weight.

However, with this prior golf bag support, the user must forcibly retract the support members which had been extended at a predetermined angle and then lock up distal ends of the support members in rings of the resilient actuating rod to prevent the support members from being extended due to the resiliency of the resilient actuating rod whenever the user carries the golf bag stood in an inclined position. Thus, this device is inconvenient to use. Furthermore, since the inclination of the golf bag in the inclined position is determined by given lengths of the support members, the supporting stableness of the golf bag is deteriorated.

Other patents show supports that automatically extend and retract, such as McGregor U.S. Pat. No. 1,197,298, Anderson U.S. Pat. No. 5,147,089 and No. 5,156,366 and Maeng U.S. Pat. No. 5,152,483. Actuation members of these patents are either slidable rods or flat pivoted levers for engaging the ground to activate the support mechanism. These activation members can be less than desirable to operate, especially on surfaces such as grass-covered areas normally associated with golf courses.

SUMMARY OF THE INVENTION

Therefore, an object of the present invention is to overcome the above-mentioned disadvantages encountered in the prior art and to provide a device for supporting a golf bag in which support legs are extended by action of actuating rods and an actuating lever when the golf bag is tilted into an inclined position so as to stand the golf bag on the ground, while the support legs are retracted by their own weight when the golf bag is erected so as to carry the golf bag, thereby providing the user with convenience in use.

Another object of this invention is to provide a golf bag having an automatic support stand which operates very effectively even on grassy ground surfaces.

In accordance with the present invention, these objects can be accomplished by providing a device for supporting a golf bag which has an upper hinge bracket fixed to an upper portion of an outer surface of a golf bag; a lower hinge bracket fixed to a lower end of the outer surface of the golf bag and positioned in the same vertical line as that of the upper hinge bracket; a pair of pivot arms pivotally connected to the upper hinge bracket; a pair of support legs fixed to the pair of pivot arms, respectively, each of the support legs having an upper hinge element at its upper half part; an actuating lever pivotably connected to the lower hinge bracket and having a lower hinge element at its free end, the actuating lever being generally in contact at its free end with the ground when the golf bag is erect; and a pair of actuating rods each pivotally connected at its upper end to the upper hinge element and pivotally connected at its lower end to the lower hinge element; whereby the actuating lever is pushed upwardly by contact with the ground so that the support legs are extended by the upward movement of the actuating lever and the rods when the golf bag is tilted toward the support legs when the bag is on the ground, and whereby the support legs are retracted by their own weight when the golf bag is erected or lifted off of the ground.

BRIEF DESCRIPTION OF THE DRAWINGS

Other objects and advantages of the present invention will become apparent from the following description of embodiments with reference to the accompanying drawings in which:

FIG. 4 is a perspective view of the device of FIG. 1 when the golf bag is stably standing on the ground after the support legs have been extended;

FIG. 4A is an enlarged detail rearwardly facing view illustrating a connection bar for the support legs;

FIG. 5A is a detailed side view showing the orientation of an actuating lever when the golf bag of FIG. 1 is in an erect, vertical position resting on the ground as shown in FIG. 1;

FIG. 5B is a side view as in FIG. 5A showing the operation of the actuating lever and its orientation when the golf bag is tilted to a position as shown in FIG. 4;

DETAILED DESCRIPTION OF THE PREFERRED EMBODIMENTS

Devices for supporting a golf bag according to the present invention and golf bags incorporating same will be now described with reference to the accompanying drawings.

Figure 1:
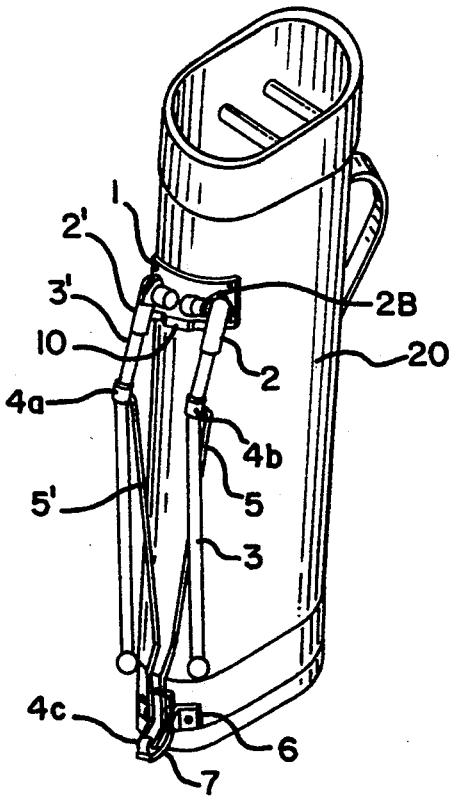
FIG. 1 is a perspective view of a golf bag provided with a device for supporting a golf bag according to an embodiment of the present invention.
Figure 2A:
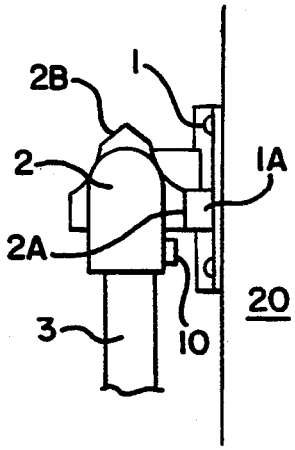
FIG. 2A is a side elevational view showing pivot arms connected to an upper hinge bracket when support legs are retracted.
Figure 2B:
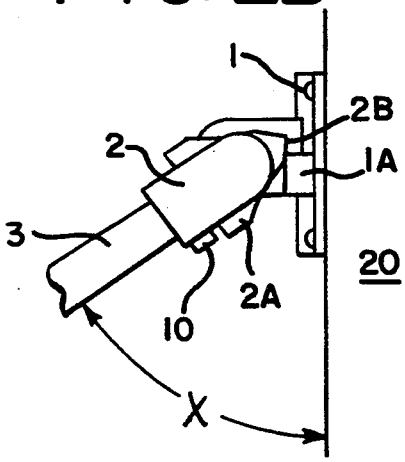
FIG. 2B is a side elevational view as in FIG. 2A, showing the pivot arms connected to the upper hinge bracket when the support legs are extended.

FIG. 1 shows a golf bag provided with a device according to the invention, and FIGS. 2A and 2B show an operation of pivotable arms coupled to hinge brackets of the golf bag. As shown in the drawings, the golf bag 20 is mounted with an upper hinge bracket 1 at an upper position of an outer surface thereof and mounted with a lower hinge bracket 6 at a lower end of the outer surface thereof by using riveting or other suitable means.

A pair of pivotable arms 2' and 2 are pivotably coupled to the upper hinge bracket 1. The pair of pivotable arms 2' and 2 are connected to a pair of support legs 3' and 3, respectively. Each of the support legs 3' and 3 preferably has a bent portion approximately at a middle portion of an upper half part of the leg. These bent portions help to stabilize the golf bag when it is supported by the legs.

Connected between the pair of pivotable arms 2' and 2 is a connection bar 10, shown also in FIG. 4 and FIG. 4A. The connection bar 10 is adapted to uniformly maintain a spacing between the pair of pivotable arms 2' and 2 regardless of the weight of the golf bag, including golf clubs, during extension and retraction of the support legs 3' and 3. In the embodiment illustrated in FIG. 4A, connection bar 10 has a pair of slots 11' and 11 to slidably mount the connection bar 10 onto pins 12' and 12 projecting from each of the respective arms 2' and 2. As shown in FIG. 4A, the outside ends of slots 11' and 11 prevent excessive separation of the legs 3' and 3 even when the golf bag 20 is full of golf clubs and accessories.

The pair of support legs 3' and 3 have a pair of hinge parts 4*a* and 4*b* at the bent portions thereof, respectively. A pair of actuating rods 5' and 5 are pivotably connected to the pair of hinge parts 4*a* and 4*b*, respectively, and extend generally downwardly.

As shown in detail in FIGS. 2A and 2B, the upper hinge bracket 1 is formed with protrusions 1A, and each of the pivotable arms 2' and 2 is formed with upper protrusions 2B and rear protrusions 2A. As the support legs 3' and 3 are retracted and extended toward and from the golf bag body 20, the rear protrusions 2A of the pivotable arm 2' and 2 are engaged with the protrusion 1A of the upper hinge bracket 1 so that the support legs 3' and 3 are retracted and extended slowly and softly to minimize the chance the support legs 3' and 3 will "slap" against the golf bag body 20. Also, as the support legs 3' and 3 are completely extended outwardly, the upper protrusions 2B are engaged with the protrusions 1A of the upper hinge bracket 1 so that the support legs 3' and 3 are stopped at a predetermined extended angle regardless of the weight of the golf bag 20.

FIGS. 5A and 5B show an embodiment having a rounded or curved offset actuating lever. As shown in the drawings, this rounded actuating lever 7 is pivotably connected to the lower hinge bracket 6 by means of a hinge pin 8. The rounded actuating lever 7 is formed at its inner end with a stop slope 9 and formed at its free or outer end with a hinge part 4*c*. Typically, the rounded actuating lever 7 is always in contact with the ground whenever the golf bag 20 is disposed on the ground. The actuating rods 5' and 5 are pivotably connected at their respective lower ends to the hinge part 4*c* of the offset actuating lever 7.

Operation of this embodiment of the device for supporting a golf bag according to the invention is as follows. First, as the golf bag 20 is erected to its upright position (the position of FIGS. 1 and 5A and which is designated by "A" in FIG. 3) from the inclined position (the position of FIGS. 4 and 5B and which is designated by "B" in FIG. 3) so that, when the user lifts the golf bag to carry it, the assembly including the support legs 3' and 3 automatically retracts toward the golf bag body 20 by its own weight. At this point, the upper protrusions 2B are disengaged from the protrusions 1A of the upper hinge bracket 1 and then the rear protrusions 2A are engaged with the protrusions 1A, so that the support legs 3' and 3 are retracted slowly and softly. As the support legs 3' and 3 are retracted toward the golf bag body 20, the actuating rods 5' and 5 connected to the support legs 3' and 3 are pushed downwardly. Upon the downward movement of the actuating rods 5' and 5, the rounded offset actuating lever 7 is turned in a counterclockwise direction to the position of FIG. 5A, so that the stop slope 9 of the actuating lever 7 is disengaged and spaced from the lower hinge bracket 6. When the support legs 5' and 5 are completely retracted as designated by "A" in FIG. 3, the support legs 3' and 3 and the actuating rods 5' and 5 are close to the outer surface of the golf bag 20 as shown in FIG. 1, so that the golf bag 20 is easy to be carried by the user.

Figure 3:
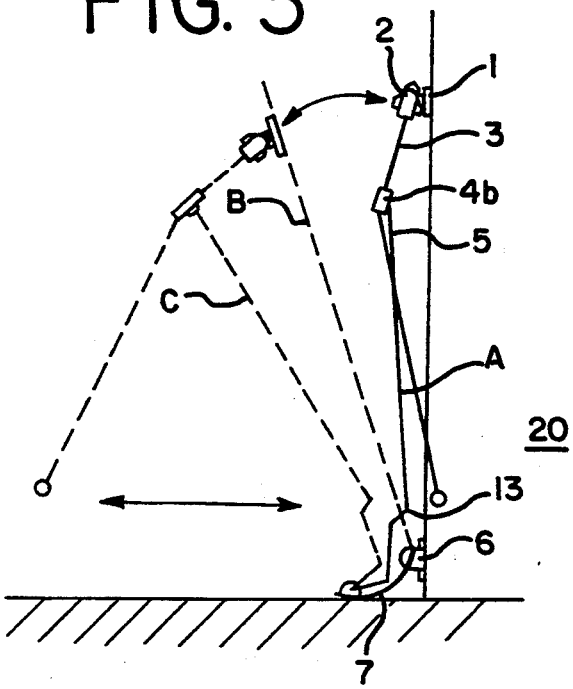
FIG. 3 is a schematic view showing operation of the device of FIG. 1 during extension and retraction of the support legs.

When the user desires to rest the golf bag on the ground to the inclined position shown in FIG. 4, the golf bag 20 is tilted toward the support legs 3' and 3 as designated by "B" in FIG. 3. The user places the bag on the ground, typically at the orientation as shown in FIGS. 1, 2A and 5A, and tilts the bag. The offset actuating lever 7 pivotally connected to the lower hinge bracket 6 comes into contact with the ground at its lower end and is pushed upwardly and also clockwise by the ground (as viewed in FIG. 5B). Upon the upward movement of the actuating lever 7, the actuating rods 5' and 5 pivotably connected to the outer end or free end of the actuating lever 7 also are pushed upwardly. At this time, the actuating rods 5' and 5 are turned counterclockwise and the support legs 3' and 3 are turned clockwise with respect to the golf bag 20 due to the trapezoid link mechanism consisting of the golf bag 20, the actuating lever 7, the actuating rods 5' and 5 and the support legs 3' and 3, so that the upper ends of the actuating rods 5' and 5 are widened with respect to the golf bag 20.

As the actuating rods 5' and 5 are pushed upwardly, the support legs 3' and 3 pivotally connected to the upper ends of the actuating rods 5' and 5 are extended as designated by "C" in FIG. 3. During the extension of the support legs 3' and 3, the rear protrusions 2A of the pivot arms 2' and 2 are disengaged from the protrusions 1A of the upper hinge bracket 1. As the support legs 3' and 3 are further extended, the upper protrusions 2B of the pivot arms 2' and 2 are engaged with the protrusion 1A of the upper hinge bracket 1 and the stop slop 9 is also engaged with the lower hinge bracket 6, so that the support legs 3' and 3 cease their extension movement.

At this time, since the lower ends of the support legs 3' and 3 and a point on the bottom of the golf bag 20 define a triangle of supporting points, the golf bag 20 is thus stably supported in the inclined position, such as shown in FIG. 4. Also, since the upper protrusions 2B of the pivot arms 2' and 2 are in engagement with the protrusion 1A of the upper hinge bracket 1 and the stop slop 9 is also in engagement with the lower hinge bracket 6, the golf bag 20 is maintained at a desired inclination angle regardless of the weight of the golf bag 20, including golf clubs and accessories. Furthermore, since the connection bar 10 is fixed between the pair of pivot arms 2' and 2, the predetermined spacing between the support legs 3' and 3 is maintained uniformly regardless of the weight of the golf bag 20.

Figure 6:
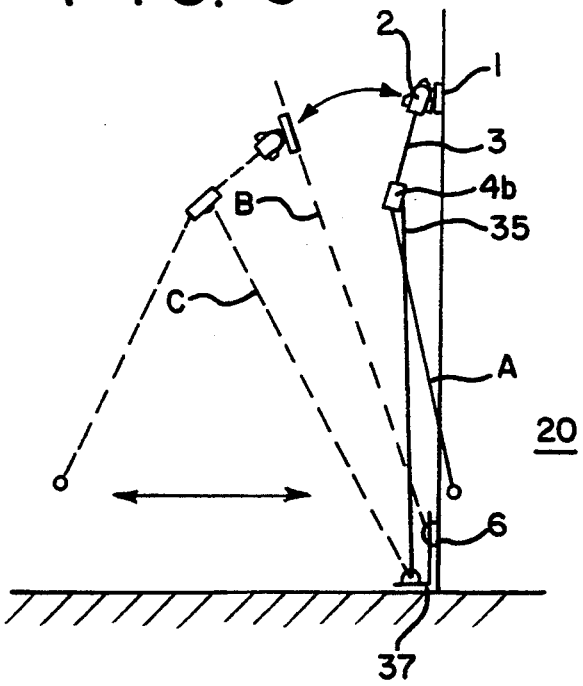
FIG. 6 is a schematic view showing operation of an alternative embodiment of the supporting golf bag according to the present invention.
Figure 7A:
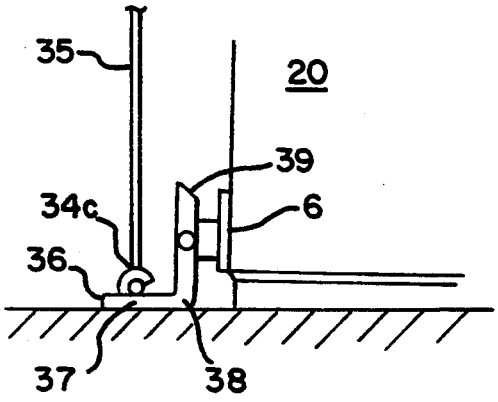
FIG. 7A is a detailed side view showing the orientation of the actuating lever when the golf bag of FIG. 6 is in its erect, vertical position resting on the ground.
Figure 7B:
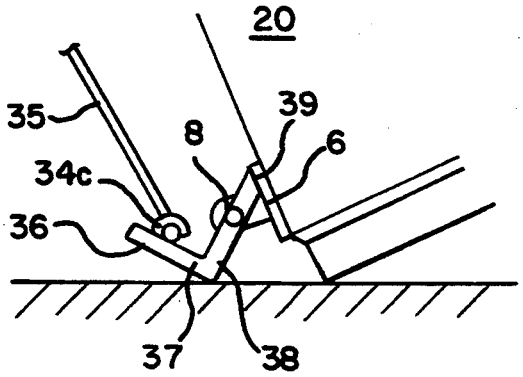
FIG. 7B is a side view as in FIG. 7A showing the operation of the actuating lever of this embodiment and its orientation when the golf bag is tilted.

With reference to the embodiment shown in FIGS. 6, 7A and 7B, the offset actuating lever 37 is much less rounded than offset actuating lever 7, being generally right-angular in overall configuration. Illustrated offset actuating lever 37 has a more precisely defined fulcrum ridge 38 than the outside curve provided by the rounded offset actuating lever 7. A substantially right-angular fulcrum ridge 38 more precisely defines an angular area or angle point to initiate rotation of the actuating lever 37 and thus more smoothly and positively effect opening of the support legs 3' and 3. The actuating lever 37 minimizes the chance that the actuating mechanism will slip or the like and provides a point of force that is not defined by a flat or a more rounded lever mechanism. Fulcrum ridge 38 imparts improved frictional engagement with otherwise low-friction surfaces to facilitate the lever rotation characteristic of the invention.

Operation of the offset actuating lever in accordance with the invention is in the nature of a bell crank to change the direction of the motion caused by the tilting of the bag. Movement of the bag 20 from the erect position to the tilted and leg-supported position not only achieves the clockwise rotation discussed herein but also lifts the free end of the offset actuating lever, thereby simultaneously moving and lifting the actuating rods in order to smoothly initiate and then complete opening of the legs. Referring specifically to an embodiment incorporating the offset actuating lever 37, it is pivotably connected to the lower hinge bracket 6 by hinge pin 8. If desired, a stop slope 39 can also be included on the attached end of the lever 37. A suitable pivotable attachment member **34*c* is provided at the free end 36 of the lever 37 to rotatably secure the actuating rod 35 thereto, which preferably has two rod members joined into fork-like component as generally seen in FIGS. 1 and 4. Because the hinge pin 8** and attached end of the offset lever are spaced above the bottom surface of the golf bag and because the free end is angularly offset from the rest of the lever, the rotating and lifting discussed herein is effected such that the offset lever cranks the actuating rod in a manner that facilitates opening of the support legs.

In operation of the embodiment shown in FIGS. 6, 7A and 7B, the golf bag 20 in its erect position is designated by "A" in FIG. 6. Movement to this position from the inclined and leg-supported position designated by "B" in FIG. 6 is automatic when the user lifts the golf bag off of the ground when the bag is inclined and leg-supported. Returning the bag from the erect, ground-engaging position shown in FIG. 7A to the inclined, ground-engaging and leg-supporting position shown in FIG. 7B is accomplished by simply tilting the golf bag 20 toward the support legs 3' and 3. Offset actuating lever 37 pivotably connected to the hinge bracket spaced above the bottom of the bag provides a fulcrum point about which the bag rotates while lever 37 simultaneously rotates on its own fulcrum ridge 38 to transfer this bag-movement motion into motion that rotates and lifts the free end 36 to move actuation rod 35 to the extended position designated at "C" in FIG. 6, which extends the support legs 3' and 3 as discussed herein.

Concerning the actuation rods 5 and 35 illustrated herein, rod 35 is of a generally straight overall configuration. Preferably, the actuation rods impart an opening force vector to the hinge parts **4*a* and 4*b* and thus to the support legs 3' and 3 when the bag is tilted and the bell crank action is carried out by the offset actuating lever. Development of such an opening force vector is facilitated by having a lower portion of the actuation rod spaced inwardly of the hinge parts 4*a* and 4*b*. This arrangement is readily apparent in FIG. 3 in which actuation rod 5 is illustrated as including inwardly directed bend portions 13 which are not directly vertically below the pivot points on the hinge parts 4*a* and 4*b* are offset therefrom by being spaced toward the golf bag and away from a location that is directly vertically under the points of connection at the hinge parts 4*a* and 4*b*. Inwardly directed bend portions 13 can be formed into the actuation rod by three bends as illustrated in FIGS. 1, 3, 4, 5A and 5**B in order to ensure the opening direction force vector is developed when the golf bag is tilted from its erect and ground-engaging position, as discussed herein.

In the embodiments of the invention discussed herein, the angle "X" (FIG. 2B) between the golf bag 20 and the support legs 3' and 3 is an angle of about 60° to about 70°, for example about 65°, when the support legs 3' and 3 are extended at the maximum. The angle "X" between the golf bag and the support legs may be adjusted in the range of about 50° to about 65° according to the weight of the golf bag itself and the clubs and accessories in the bag. Generally, the leaning, supported bag full of clubs will remain stable and will be easily picked up if the angle "Y" between the bag and the ground is no less than about 60°.

As apparent from the above-description, in the device for supporting a golf bag according to the present invention, the support legs are automatically extended by the upward movement of the lever and of the connecting actuating rod assembly when the golf bag is tilted into the inclined position while the support legs are automatically retracted by the downward movement of the actuating rods and the lever when the golf bag is erected into the upright position. Therefore, the device can provide the user with considerable convenience in standing and carrying operations of the golf bag. In addition, the device can stably support the golf bag when the golf bag stands on the ground in the inclined position.

It is to be understood that many alternatives and modifications may be made by those having skill in the art to the devices disclosed herein without departing from the spirit and scope of the invention. Therefore, the presently illustrated embodiments have been shown only by way of example and should not be taken to limit the scope of the following claims.

I claim:

1. A device for supporting a golf bag, comprising:

an upper hinge bracket fixed to an upper portion of an outer surface of a golf bag;

a lower hinge bracket fixed to a lower end portion of the outer surface of the golf bag and positioned in the same vertical line as the upper hinge bracket;

a pair of pivot arms pivotably connected to the upper hinge bracket;

a pair of support legs fixed to the pair of pivot arms, respectively, each of the support legs having an upper hinge element at an upper part thereof;

an offset actuating lever having an inner end portion and a free end portion that is upturned with respect to and angularly offset from said inner end portion to define a fulcrum location between said inner end portion and said free end portion, said offset actuating lever pivotably connected to the lower hinge bracket and having a lower hinge element at its said free end portion and spaced away from said fulcrum location; and a pair of actuating rods each pivotably connected at its upper end to the upper hinge element and pivotably connected at its lower end to the lower hinge element, said free end portion of the offset actuating lever being rotated upwardly by rocking of the offset lever along said fulcrum location thereof when said fulcrum location is in contact with the ground so that the support legs are extended by the upward movement of the free end of the offset actuating lever and the rods when the golf bag on the ground is tilted toward the support legs, and the support legs being retracted by their own weight when the golf bag is erected.

2. The device for supporting a golf bag in accordance with claim 1, wherein said upper hinge bracket is provided with a protrusion and said pivot arms are each provided with a rear protrusion adapted to be engaged with said protrusion of the upper hinge bracket so that said support legs are extended and retracted slowly and softly.

3. The device for supporting a golf bag in accordance with claim 2, wherein said pivot arms are each provided with an upper protrusion and said actuating lever is provided at its inner end with a stop slope, said upper protrusion being engaged with said protrusion of the upper hinge bracket and said stop slope being engaged with said lower hinge bracket when said support legs are extended to a predetermined angle, the extension operation of said support legs being stopped at the predetermined angle.

4. The device for supporting a golf bag in accordance with claim 3, wherein said predetermined angle of said support legs is in the range of about 50° to about 65°.

5. The device for supporting a golf bag in accordance with claim 1, wherein a connection bar is fixed between said pair of pivot arms so that an angle between said support legs is uniformly maintained when the support legs are extended to a predetermined angle.

6. The device for supporting a golf bag in accordance with claim 1, wherein said offset actuating lever is pivotally connected to the lower hinge bracket at a pivot location spaced upwardly from the ground.

7. The device for supporting a golf bag in accordance with claim 1, wherein said free end portion and said inner end portion of the offset actuating lever are generally perpendicular to each other.

8. The device for supporting a golf bag in accordance with claim 1, wherein said offset actuating lever is of a generally curved configuration including said free end portion and said inner end portion which are angularly offset from one another.

9. The device for supporting a golf bag in accordance with claim 1, wherein said offset actuating lever is a bell crank, and said fulcrum location is a fulcrum ridge.

10. The device for supporting a golf bag in accordance with claim 1, wherein said pair of actuating rods each include at least one bend defining an offset length thereof.

11. The device for supporting a golf bag in accordance with claim 1, wherein said free end portion of the offset activating lever is in contact with the ground when the golf bag is erect.

12. The device for supporting a golf bag in accordance with claim 1, wherein said offset actuating lever changes the direction of the motion imparted to it when the golf bag on the ground is tilted toward the support legs.

13. An automatic support stand and golf bag supported thereby, comprising:

a support leg assembly pivotably connectable to an upper portion of a generally vertical wall of a golf bag, said support leg assembly having a pair of support legs that extend outwardly from the wall of the golf bag;

an offset actuating lever pivotably connectable to a lower portion of the golf bag at a pivot location spaced upwardly from a bottom, ground-engaging surface of the golf bag, said offset actuating lever having a lower connecting member;

an actuating rod assembly pivotably connected at an upper end thereof to said support leg assembly and at a lower end thereof to said lower connecting member; and said offset actuating lever having a first section extending from said pivot location at the lower portion of the golf bag, said offset actuating lever having a second section containing the lower connecting member and being offset from said first section such that said second section but not said first section is oriented for ground engagement when the golf bag is in an upright, erect orientation and such that said second section having the lower connecting member is rotated upwardly about a fulcrum surface spaced apart from said lower connecting member by contact with a ground surface so that the support legs are extended by a rocking motion of the offset actuating lever that effects the upward movement of the second section of the actuating lever and the actuating rod assembly when the golf bag on the ground surface is tilted toward the support legs.

14. The automatic support stand and bag in accordance with claim 13, wherein said first section and said second section of the offset actuating lever are generally perpendicular to each other.

15. The automatic support stand and bag in accordance with claim 13, wherein said offset actuating lever is of a generally curved configuration.

16. The automatic support stand and bag in accordance with claim 13, wherein said offset actuating lever is a bell crank having a fulcrum ridge that engages the ground.

17. The automatic support stand and bag in accordance with claim 13, further including a connection bar slidably secured between said support legs to limit spreading between the support legs when the golf bag is on the ground and tilted toward the support legs.

18. The automatic support stand and bag in accordance with claim 13, wherein said actuation rod assembly has a substantially straight profile between its said upper end and its said lower end.

19. The automatic support stand and bag in accordance with claim 13, wherein said activation rod assembly has a profile between its said upper end and its said lower end which includes at least one bend defining an offset length spaced toward the golf bag.

20. The automatic support stand and bag in accordance with claim 19, wherein said bend defining the offset length is spaced closer to said generally vertical wall of the golf bag to which the automatic support stand is mounted than is said upper connecting member of the support leg assembly.

21. The automatic support stand and bag in accordance with claim 13, wherein an inclination angle is defined between the ground and said vertical wall of the golf bag to which the automatic support stand is mounted, said inclination angle being no less than about 60°.

22. The automatic support stand and bag in accordance with claim 21, wherein said inclination angle is maintained by engagement between a rear protrusion of said support leg assembly and a protrusion on a bracket for attaching the support leg assembly to said upper portion of the generally vertical wall of the golf bag.

23. The automatic support stand and bag in accordance with claim 22, wherein a connection bar is fixed between a pair of pivot arms fixed to the support legs so that an angle between said support legs is uniformly maintained when the golf bag is tilted to said inclination angle.

24. The automatic support stand and bag in accordance with claim 13, wherein said fulcrum surface between said first section and said second section is in contact with the ground when the support legs are extended by the rocking motion of the offset actuating lever.

25. The automatic support stand and bag in accordance with claim 13, wherein said offset actuating lever changes the direction of the motion imparted to it when the golf bag on the ground is tilted toward the support legs.

26. The automatic support stand and bag in accordance with claim 13, wherein said support leg assembly includes a bracket protrusion and said pair of support legs are each associated with a rear protrusion, and said rear protrusion is adapted to engage said bracket protrusion so that said support legs are retracted softly.

27. The automatic support stand and bag in accordance with claim 26, wherein said first section of the offset actuating lever is provided with a stop slope, said stop slope being engaged with a member at said lower portion of the golf bag when said support legs are extended to a predetermined angle, the extension operation of said support legs being stopped at the predetermined angle.

28. The automatic support stand and bag in accordance with claim 27, wherein said predetermined angle of said support legs is in the range of about 50° to about 65°.

* * * * *